US012723369B2

(12) United States Patent
Glasser et al.

(10) Patent No.: US 12,723,369 B2
(45) Date of Patent: Sep. 1, 2026

(54) SLEW ROTATION SENSOR

(71) Applicant: Doosan Bobcat North America Inc., West Fargo, ND (US)

(72) Inventors: David L. Glasser, Bismarck, ND (US); Thomas M. Sagaser, Mandan, ND (US); Matthew Walter Keller, Bismarck, ND (US); Michael Kindel, Bismarck, ND (US); Blake M. Emmel, Bismarck, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 0 days.

(21) Appl. No.: 19/080,417

(22) Filed: Mar. 14, 2025

(65) Prior Publication Data

US 2025/0290281 A1 Sep. 18, 2025

Related U.S. Application Data

(60) Provisional application No. 63/565,269, filed on Mar. 14, 2024.

(51) Int. Cl.

| | |
|---|---|
| ***E02F 9/12*** | (2006.01) |
| ***E02F 9/10*** | (2006.01) |
| ***E02F 9/20*** | (2006.01) |

(52) U.S. Cl.

CPC ..... *E02F 9/10* (2013.01); *E02F 9/2062* (2013.01)

(58) Field of Classification Search

CPC ... E02F 9/10; E02F 9/2062; E02F 9/12; E02F 9/121; E02F 9/123

See application file for complete search history.

(56) References Cited

U.S. PATENT DOCUMENTS

| | | | |
|---|---|---|---|
| 4,552,503 | A | 11/1985 | Mouri et al. |
| 4,746,264 | A | 5/1988 | Kishi et al. |
| 5,657,544 | A | 8/1997 | Ota et al. |

(Continued)

FOREIGN PATENT DOCUMENTS

| | | | |
|---|---|---|---|
| CN | 112499500 | A | 3/2021 |
| GB | 2 134 876 | A | 8/1984 |

(Continued)

OTHER PUBLICATIONS https://www.nachi-fujikoshi.co.jp/eng/yua/rotary/rotary_a.htm, downloaded Sep. 10, 2025, Nachi—Nachi-Fujikoshi Corp., Products, 6 pages.

(Continued)

*Primary Examiner* — Jamie L McGowan

(74) *Attorney, Agent, or Firm* — Westman, Champlin & Koehler, PA

(57) ABSTRACT

A power machine or excavator includes a swivel assembly coupling the upper frame portion to the lower frame portion, while providing accurate slew position measurement using a swivel sensor which is positioned to reduce measurement errors over a thermal range of operation of the power machine. The swivel assembly includes a swivel barrel configured to be attached to the lower frame portion of the power machine, and a swivel spool configured to be attached to the upper frame portion. The swivel sensor is positioned and configured to provide a sensor output indicative of a rotational position of the upper frame portion relative to the lower frame portion.

19 Claims, 12 Drawing Sheets

(56) References Cited

U.S. PATENT DOCUMENTS

| | | | | |
|---|---|---|---|---|
| 6,113,276 | A | 9/2000 | Bourgeois-Jacquet | |
| 6,199,442 | B1 | 3/2001 | Bauer et al. | |
| 6,481,296 | B2 | 11/2002 | Jin et al. | |
| 6,672,175 | B2 | 1/2004 | Jin et al. | |
| 6,867,584 | B1 | 3/2005 | Kurita et al. | |
| 6,906,513 | B2 | 6/2005 | Dünisch et al. | |
| 7,055,269 | B2 | 6/2006 | Lovato | |
| 7,157,907 | B2 | 1/2007 | Sato | |
| 7,710,110 | B2 | 5/2010 | Patil et al. | |
| 8,180,532 | B2 | 5/2012 | O'Halloran et al. | |
| 8,694,204 | B2 | 4/2014 | Reeb et al. | |
| 8,816,678 | B2 | 8/2014 | Kitanaka et al. | |
| 9,115,483 | B2 | 8/2015 | Sakuda et al. | |
| 9,458,597 | B2 | 10/2016 | Ikegami et al. | |
| 9,528,245 | B2 | 12/2016 | Goto et al. | |
| 9,580,885 | B2 | 2/2017 | Wu et al. | |
| 9,783,961 | B2 | 10/2017 | Ikegami et al. | |
| 9,879,403 | B2 | 1/2018 | White et al. | |
| 10,494,788 | B2 | 12/2019 | Glasser et al. | |
| 11,512,450 | B2 | 11/2022 | Sulzer | |
| 11,577,796 | B2 | 2/2023 | Jagtap et al. | |
| 11,976,441 | B2 * | 5/2024 | Bae | E02F 9/006 |
| 2004/0045289 | A1 | 3/2004 | Ikeda et al. | |
| 2014/0172246 | A1 | 6/2014 | Farmer et al. | |
| 2015/0300479 | A1 | 10/2015 | Frank | |
| 2017/0211257 | A1 * | 7/2017 | Terauchi | E02F 9/123 |
| 2018/0282975 | A1 | 10/2018 | Kawamura et al. | |
| 2021/0277625 | A1 * | 9/2021 | Bae | E02F 9/006 |
| 2022/0018648 | A1 | 1/2022 | L et al. | |
| 2022/0136208 | A1 * | 5/2022 | Okada | E02F 9/121 285/93 |
| 2022/0412050 | A1 | 12/2022 | Hoaby et al. | |
| 2023/0024622 | A1 | 1/2023 | Hoaby et al. | |
| 2023/0265639 | A1 * | 8/2023 | Yonekura | E02F 3/964 |
| 2023/0417017 | A1 * | 12/2023 | Yuasa | E02F 9/264 |
| 2025/0290281 | A1 * | 9/2025 | Glasser | E02F 9/264 |
| 2026/0055574 | A1 * | 2/2026 | Kageyama | E02F 9/006 |

FOREIGN PATENT DOCUMENTS

| | | | |
|---|---|---|---|
| JP | H07-138995 | A | 5/1995 |
| JP | 2013023865 | A | 2/2013 |

OTHER PUBLICATIONS

International Search Report for International Application No. PCT/US2025/020018, dated Jun. 2, 2025, 3 pages.

Written Opinion for International Application No. PCT/US2025/020018, dated Jun. 2, 2025, 4 pages.

* cited by examiner

SLEW ROTATION SENSOR

CROSS-REFERENCE TO RELATED APPLICATION(S)

This application claims the benefit of U.S. provisional application No. 63/565,269, filed on Mar. 14, 2024, the content of which is hereby incorporated by reference in its entirety.

BACKGROUND

This disclosure is directed toward power machines, such as excavators, which have an upper frame structure which rotates relative to a lower frame structure using a swivel assembly. More particularly, this disclosure is directed a slew position sensor, and excavators utilizing the sensor, which measures slew rotation.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

Excavators are a known type of power machine that have an undercarriage or lower frame structure and an upper machine portion, commonly referred to as a house, which selectively rotates on the undercarriage about a swivel assembly. Using a slew motor or drive, the upper machine portion of the excavator pivots with respect to the undercarriage about a vertical axis on a swivel joint, which allows for rotational movement of the upper machine portion in either direction relative to the undercarriage.

Frequently, it is difficult to precisely determine the rotational position of the upper machine portion of an excavator relative to the undercarriage. For electronic detection of the upper machine portion relative to the undercarriage using sensors, if electrical wires or cables are routed through the swivel joint, it could be necessary to protect the wires or cables by limiting the rotation of the upper machine portion relative to the undercarriage. Also, placing positioning sensors on the house or undercarriage is typically not a reliable or cost-effective solution. Further, some systems for determining rotational or slew position with a positioning sensor are highly susceptible to thermal effects which introduce significant measurement errors. A measurement error of a few degrees in rotation can translate to an implement positioning error of several feet.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. This Summary is not intended to identify key features or essential features of the claimed subject matter.

Disclosed are swivel assemblies and power machines, such as excavators, which include the swivel assemblies. The swivel assemblies provide accurate slew position measurement using a swivel sensor which is positioned to reduce measurement errors over a thermal range of operation of the power machine.

In one aspect, a swivel assembly is provided for a power machine having an upper frame portion configured to be rotatably coupled to a lower frame portion by the swivel assembly to allow rotation of the upper frame portion relative to the lower frame portion under power of a slew motor. The swivel assembly includes a swivel barrel configured to be attached to the lower frame portion of the power machine. A swivel spool of the swivel assembly is configured to be attached to the upper frame portion of the power machine and to rotate relative to the swivel barrel about a swivel axis as the upper frame portion rotates relative to the lower frame portion. A portion of the swivel spool extends through a portion of the swivel barrel. A swivel sensor is included with the swivel assembly, with the sensor positioned below a top of the swivel barrel. In some exemplary embodiments, the swivel sensor is positioned below or proximate a bottom of the swivel spool or swivel barrel and is configured to provide a sensor output indicative of a rotational position of the upper frame portion relative to the lower frame portion.

In some aspects of the swivel assembly, the swivel sensor is positioned below or proximate the bottom of the swivel spool or the bottom of the swivel barrel at a position which is in-line with the swivel axis. The swivel sensor is, in some embodiments, coupled to a bottom of the swivel spool such that the swivel sensor rotates with the swivel spool and the upper frame structure. The swivel sensor is, in other embodiments, proximate the bottom of the swivel spool, but inset into the swivel spool. A sensed feature or component is positioned proximate the swivel sensor. If the swivel sensor is coupled to the bottom of the swivel spool, for example, the sensed feature or component is coupled to the swivel barrel in some embodiments. A cap or other mount configured to be secured to a bottom of the swivel barrel is provided in some embodiments to couple the sensed feature or component to the bottom of the swivel barrel.

In some aspects, the swivel sensor can be a Hall-effect sensor or other sensor configured to sense the feature, such as a magnet, and to provide the sensor output indicative of the rotational position of the upper frame portion relative to the lower frame portion. The sensor can include wireless transmission capability, or the sensor can be a wired sensor with the wire connection to control circuitry being routed through a sensor wire bore extending vertically through the swivel spool. The sensor wire bore can be laterally offset from the swivel axis, allowing a plurality of hydraulic connection bores, extending vertically from a top of the swivel spool to positions at least partially through the swivel spool, to be more easily configured.

In another aspect, a power machine or excavator is provided. The power machine includes a frame having an upper frame portion and a lower frame portion. Control circuitry is supported by the upper frame portion. A plurality of tractive elements are coupled to the lower frame portion. A swivel assembly is provided to couple the upper frame portion to the lower frame portion to allow rotation of the upper frame portion relative to the lower frame portion. The swivel assembly includes a swivel barrel configured to be attached to the lower frame portion of the power machine and a swivel spool configured to be attached to the upper frame portion of the power machine and to rotate relative to the swivel barrel about a swivel axis as the upper frame portion rotates relative to the lower frame portion. A portion of the swivel spool extends through a portion of the swivel barrel. A swivel sensor is positioned below a top of the swivel barrel, and in some embodiments below or proximate a bottom of the swivel spool or the swivel barrel and is configured to provide a sensor output, indicative of a rotational position of the upper frame portion relative to the lower frame portion, to the control circuitry. A slew motor is configured to rotate the upper frame portion relative to the lower frame portion under the control of the control circuitry.

In some aspects, a swivel assembly for a power machine includes a swivel barrel configured to be attached to a lower frame portion of the power machine, and a swivel spool configured to be attached to an upper frame portion of the power machine and to rotate relative to the swivel barrel about a swivel axis as the upper frame portion rotates relative to the lower frame portion. A sensor target is offset from the swivel axis and positioned external to the swivel barrel and the swivel spool. The sensor target is configured to be coupled to the swivel barrel or lower frame portion of the power machine such that a sensor target position is fixed relative to the swivel barrel. A swivel sensor is offset from the swivel axis and positioned external to the swivel barrel and the swivel spool. The swivel sensor is configured to be coupled to the swivel spool or upper frame portion of the power machine such that a swivel sensor position is fixed relative to the swivel spool. The swivel sensor is configured to sense the sensor target to provide a sensor output indicative of a rotational position of the upper frame portion relative to the lower frame portion.

In another aspect, the swivel sensor encircles the swivel spool. The swivel sensor is a circular Hall-effect sensor positioned concentric to the swivel axis, and the sensor target comprises a magnet.

In another aspect, the sensor target has a helical ring shape having a surface with varying distances from the swivel sensor, and the swivel sensor is a proximity sensor configured to provide the sensor output indicative of a distance between the swivel sensor and the surface of the sensor target. The proximity sensor can be for example an inductive proximity sensor with a metallic material surface of the sensor target, a Hall-effect proximity sensor with a magnetic material surface of the sensor target, or time-of-flight laser distance proximity sensor.

Figure 1:
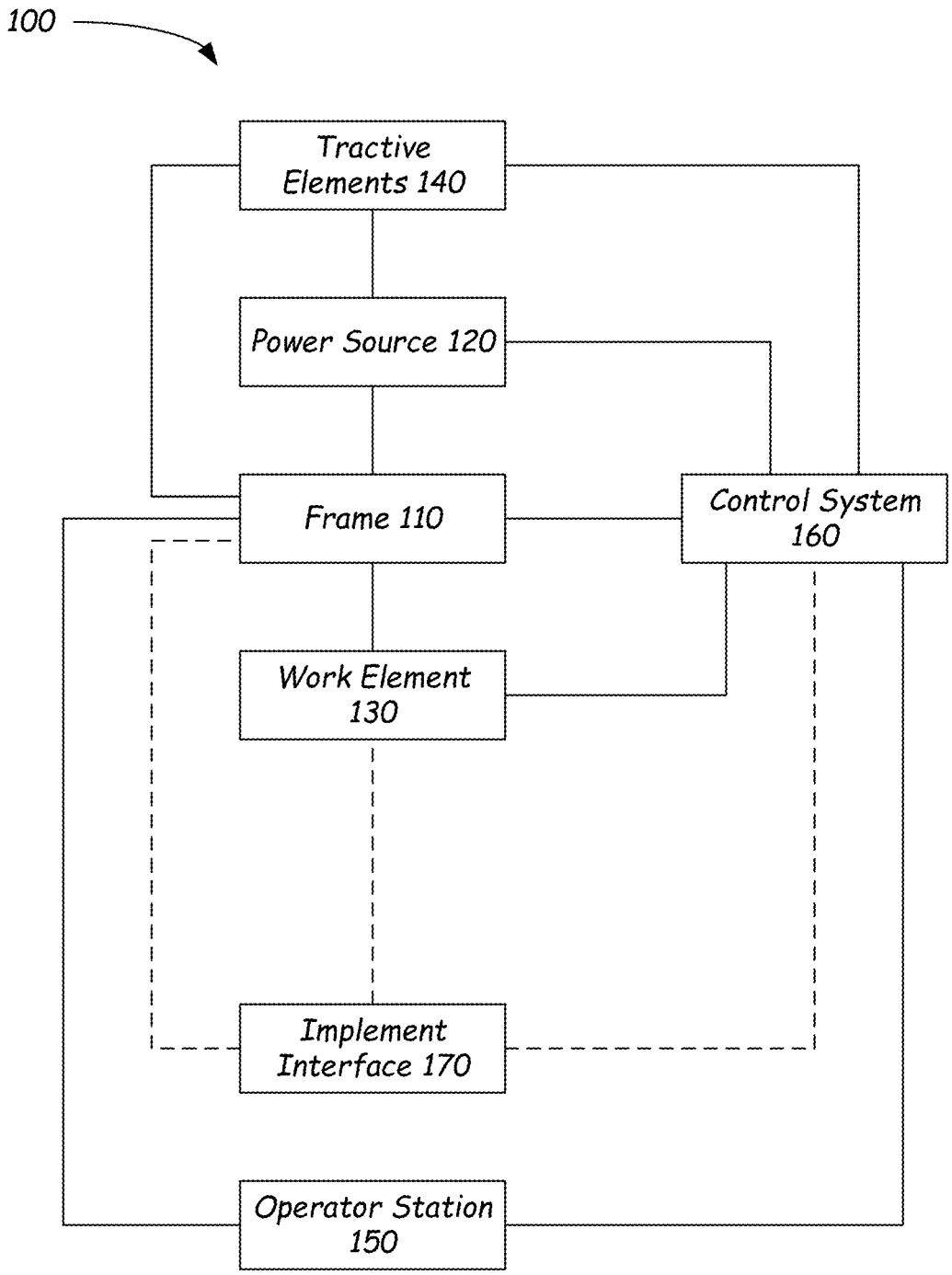
FIG. 1 is a block diagram illustrating functional systems of a representative power machine on which embodiments of the present disclosure can be practiced.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

Disclosed embodiments illustrate excavators including a slew position sensor configured to provide sensor data indicative of a rotational position of the house or upper machine portion relative to the undercarriage or lower machine portion. In some exemplary embodiments, the slew position sensor is included in a swivel assembly to provide improved slew position determination, case of manufacturing, and other benefits some of which are discussed in this disclosure. Some of these disclosed embodiments utilize a slew position sensor which is located below a top of the swivel barrel, and in some embodiments below or proximate a bottom of the swivel spool or a bottom of the swivel barrel. Such placement of the slew position sensor provides numerous advantages. As compared to designs having the slew position senor at the top of the swivel spool and above the top of the swivel barrel, disclosed embodiments minimize sensor measurement errors caused by thermal effects over a thermal range, providing a significantly more accurate slew position measurement. More accuracy in the slew position measurement is important for implementing automated or semi-automated functionality such as return to dig or trench functionality. Disclosed embodiments also eliminate a need for occupy the center of the top of the swivel spool body with sensor related components. As space in the swivel spool body is often at a premium when designing a swivel assembly that can accommodate a number of hydraulic connections through the swivel spool, this provides significant design advantages.

In other disclosed embodiments a sensor target is offset from the swivel axis and is positioned external to the swivel barrel and the swivel spool. A swivel sensor is also offset from the swivel axis and is positioned external to the swivel barrel and the swivel spool. The swivel sensor is configured to sense the sensor target to provide a sensor output indicative of a rotational position of the upper frame portion relative to the lower frame portion. The swivel sensor is in some embodiments a circular Hall-effect sensor which encircles the swivel spool, while the sensor target is a magnet attached at a fixed position to the swivel barrel or a portion of the undercarriage. In other embodiments, the swivel sensor includes one or more proximity sensors, while the sensor target has a helical ring shape with a surface which varies in distance form the one or more proximity sensors. An output of the swivel sensor is indicative of the distance between the sensor and the surface of the target, and thereby indicative of the rotational position of the upper frame portion relative to the lower frame portion.

Figure 2:
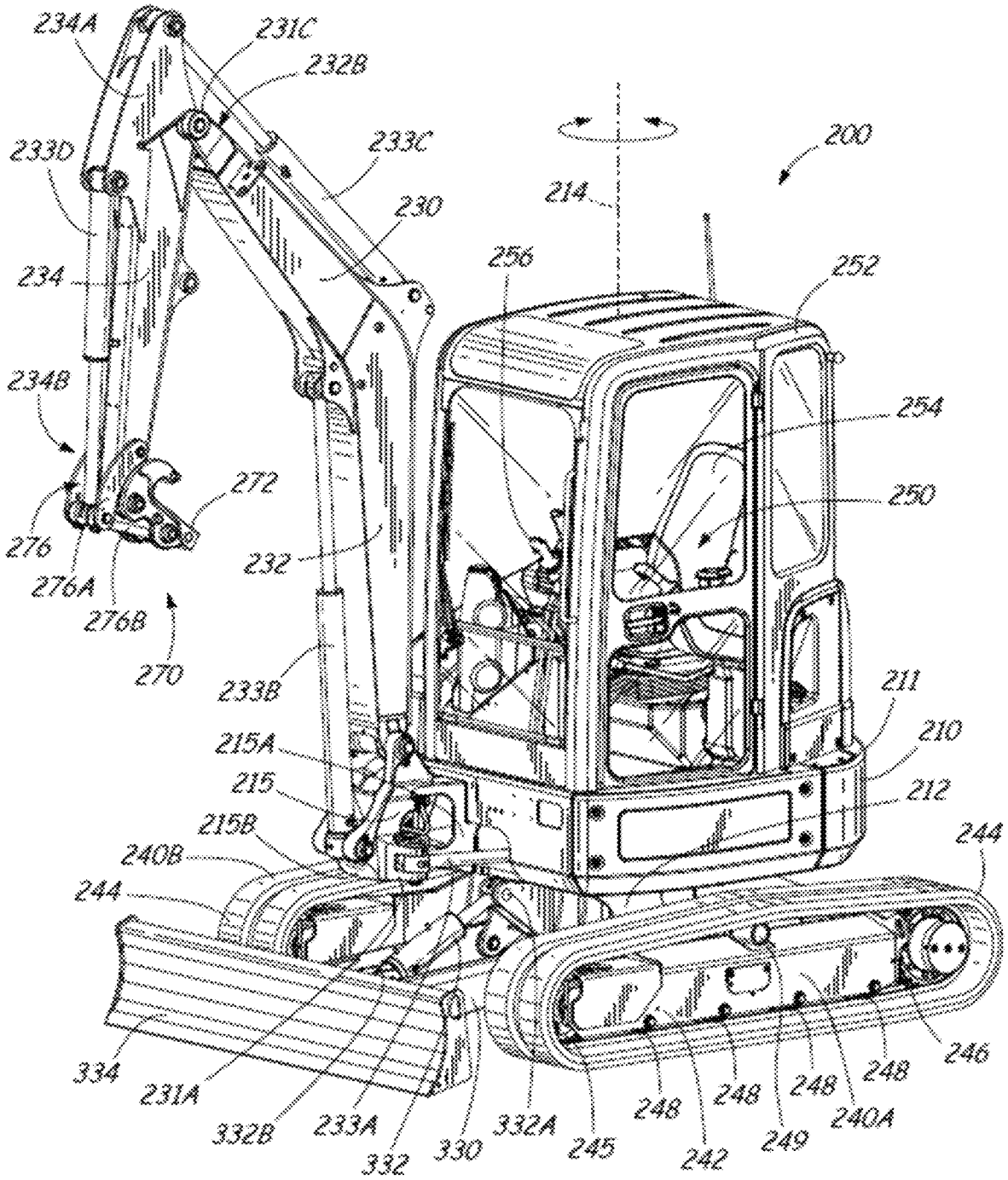
FIG. 2 is a front left perspective view of a representative power machine in the form of an excavator on which the disclosed embodiments can be practiced.
Figure 3:
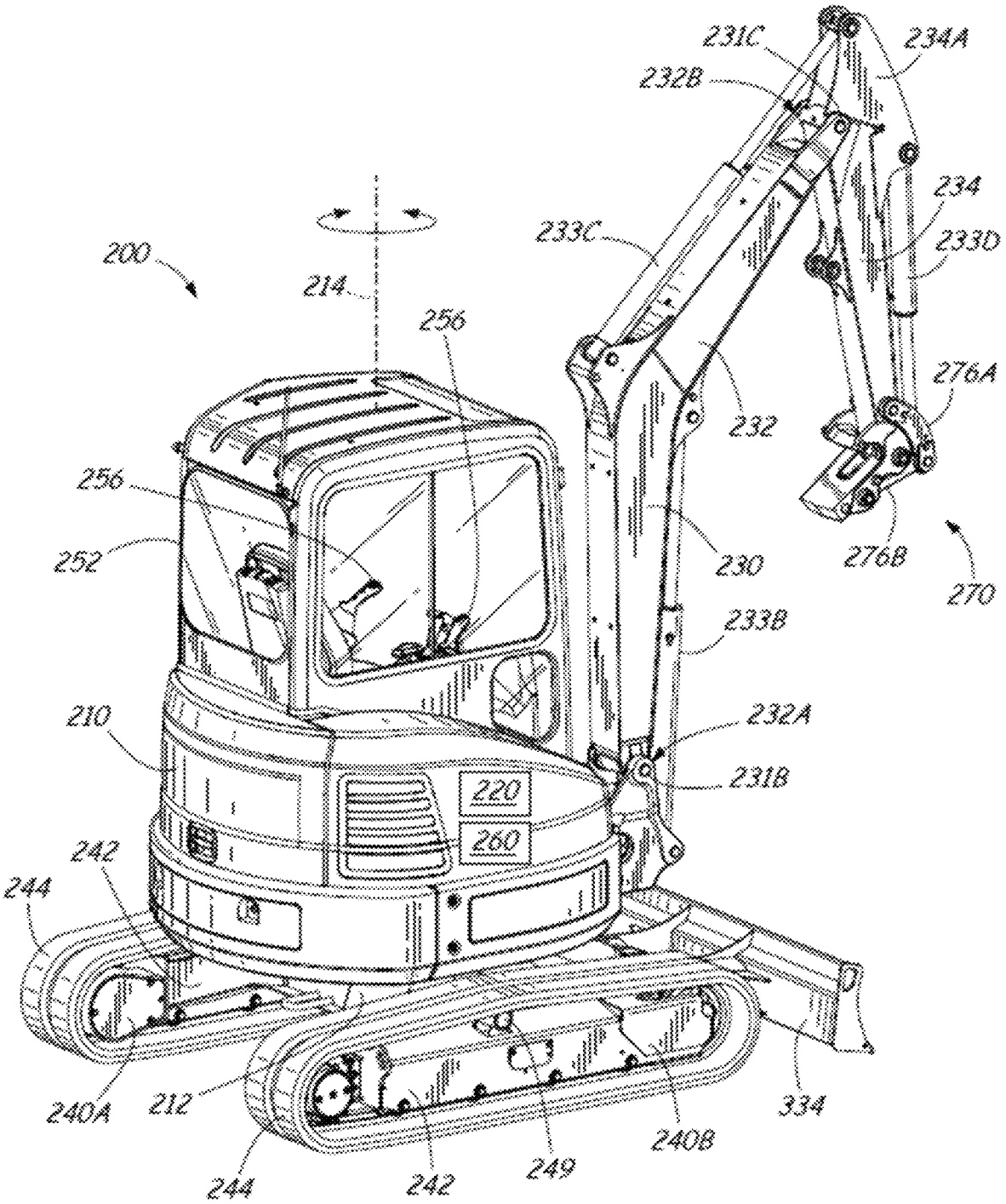
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIG. 2-3. For the sake of brevity, only one power machine is discussed. However, the disclosed teachings can be practiced on any of a number of power machines, including power machines of different types from the representative, illustrated power machine. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Referring now to FIG. 1, a block diagram illustrates the basic systems of a power machine 100 upon which the embodiments discussed below can be advantageously incorporated and can be any of several distinct types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm structure to which an implement 180 such as a bucket is attached such as by a pinning arrangement. The work element, i.e., the lift arm structure can be manipulated to position the implement 180 for performing the task. The implement 180, in some instances can be positioned relative to the work element, such as by rotating a bucket relative to a lift arm structure, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement 180, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of several implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm structure or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier. Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that are capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that can control at least some of the operator-controlled functions on the power machine.

Figure 4:
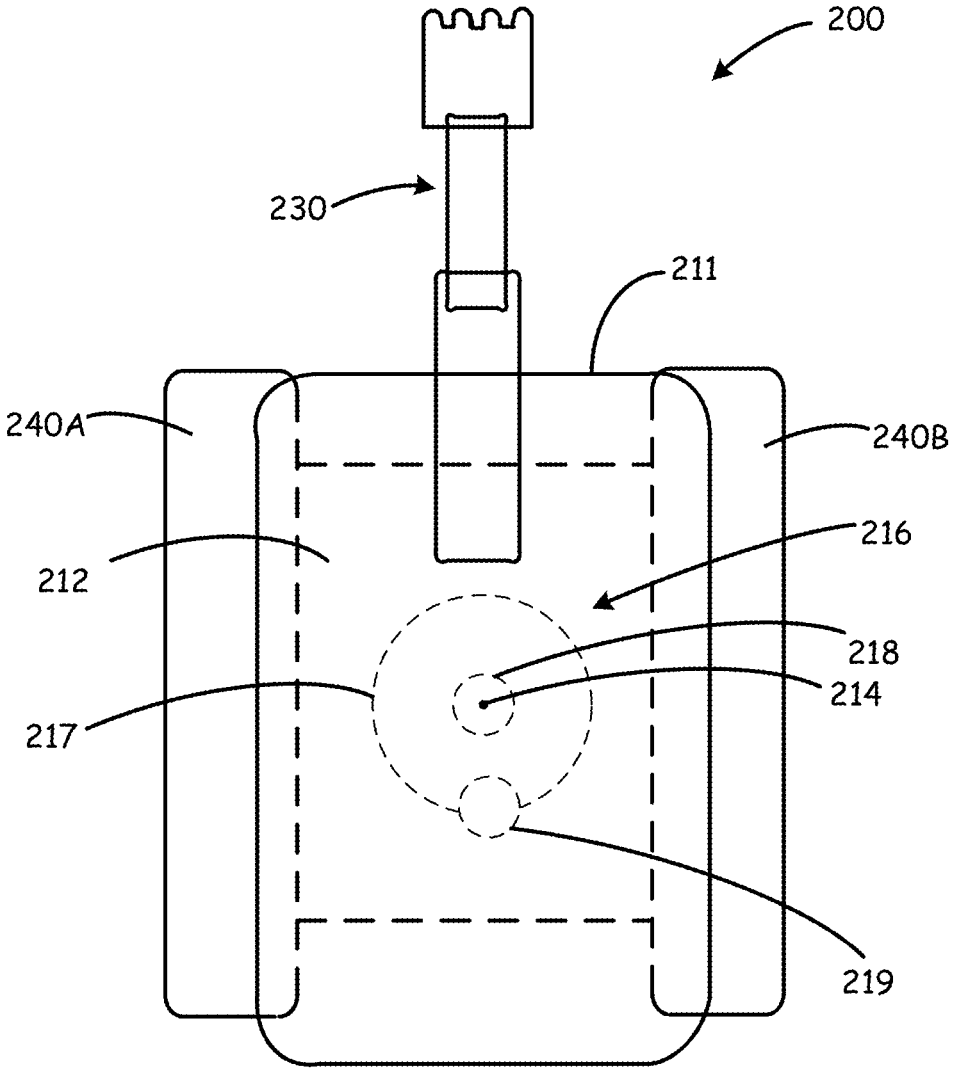
FIG. 4 is a top diagrammatic view of an excavator illustrating a swivel assembly in accordance with an exemplary embodiment.

FIGS. 2-3 are perspective views illustrating an excavator 200, which is one particular example of a power machine of the type illustrated in FIG. 1, on which the disclosed embodiments can be employed. FIG. 4 is a top diagrammatic view illustrating portions of excavator 200, including a swivel joint, a slew bearing, and a slew motor. Unless specifically noted otherwise, embodiments disclosed below can be practiced on a variety of power machines, with the excavator 200 being only one of those power machines.

Excavator 200 is described below for illustrative purposes. Not every excavator or power machine on which the illustrative embodiments can be practiced need have all the features or be limited to the features that excavator 200 has. Excavator 200 has a frame 210 that supports and encloses a power system 220 (represented in FIG. 3 as a block, as the actual power system is enclosed within the frame 210). In some embodiments the power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. In other embodiments, the power system includes an electrical power source or a hybrid-electric power source. In such other embodiments, a hydraulic system may not be needed and actuators on the power machine can be electric actuators instead of hydraulic actuators. However, some embodiments having an electric power source do include a hydraulic system driven by an electric motor. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260, is provided for controlling the various work elements. Control system 260 includes operator input devices, which interact with the power system 220 to selectively provide power signals to actuators to control work functions on the excavator 200. In some embodiments, the operator input devices include at least two two-axis operator input devices to which operator functions can be mapped.

Frame 210 includes an upper frame portion or house 211 that is pivotally mounted on a lower frame portion or undercarriage 212 via a swivel joint 216 (shown in FIG. 4). The swivel joint includes a bearing or swivel assembly 218, a ring gear 217, and a slew motor 219 with a pinion gear (not pictured) that engages the ring gear to swivel the house 211. The slew motor 219 receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic or electrical conduits are fed through the swivel joint to provide either pressurized hydraulic fluid or electric power to the tractive elements and one or more work elements such as lift arm structure 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion 232, known generally as a boom, and a second portion 234, known as an arm or a dipper. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that can accept and securing a variety of different implements to the lift arm structure 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown) available for connection to an implement on the lift arm structure 230. In some embodiments, the implement power source includes pressurized hydraulic fluid port to which an implement can be coupled. The pressurized hydraulic fluid port selectively provides pressurized hydraulic fluid for powering one or more functions or actuators on an implement. In addition, or in the alternative, the implement power source can include an electrical power source for powering electrical actuators and/or an electronic controller on an implement. The electrical power source can also include electrical conduits that are in communication with a data bus on the excavator 200 to allow communication between a controller on an implement and electronic devices on the excavator 200.

The lower frame portion 212 supports and has attached to it a pair of tractive elements, identified in FIG. 2-3 as left track drive assembly 240A and right track drive assembly 240B. Each of the tractive elements 240A, 240B has a track frame 242 that is coupled to the lower frame portion 212. The track frame 242 supports and is surrounded by an endless track 244, which rotates under power to propel the excavator 200 over a support surface. Various elements are coupled to or otherwise supported by the track frame 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 provides tension on track 244 and prevents the track from rubbing on track frame 242.

A second, or lower, lift arm structure 330 is pivotally attached to the lower frame portion 212. A lower lift arm actuator 332 is pivotally coupled to the lower frame portion 212 at a first end 332A and to the lower lift arm structure 330 at a second end 332B. The lower lift arm structure 330 is configured to carry a lower implement 334, which in one embodiment is a blade as is shown in FIGS. 2-3. The lower implement 334 can be rigidly fixed to the lower lift arm structure 330 such that it is integral to the lift arm structure. Alternatively, the lower implement can be pivotally attached to the lower lift arm structure via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm structure 330 to pivot with respect to the undercarriage or lower frame portion 212, thereby raising and lowering the lower implement 334.

Upper frame portion or house 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm structure 230, the lower lift arm structure 330, the traction system 240A, 240B, pivoting the house 211 and so forth.

Excavator 200 provides a variety of different operator input devices 256 to control various functions. For example, hydraulic joysticks are provided to control the lift arm structure 230 and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control. Also, in some embodiments, excavator 200 is configured to be operated remotely, instead of or in addition to from operator station 250. This can include applications where at least some of the operator-controlled functions of the power machine can be operated from an operating position associated with an implement that is coupled to the power machine. Alternatively, with some embodiments, a remote-control device can be provided (i.e., remote from both of the power machine and any implement to which is it coupled) that can control at least some of the operator-controlled functions on the power machine.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 5:
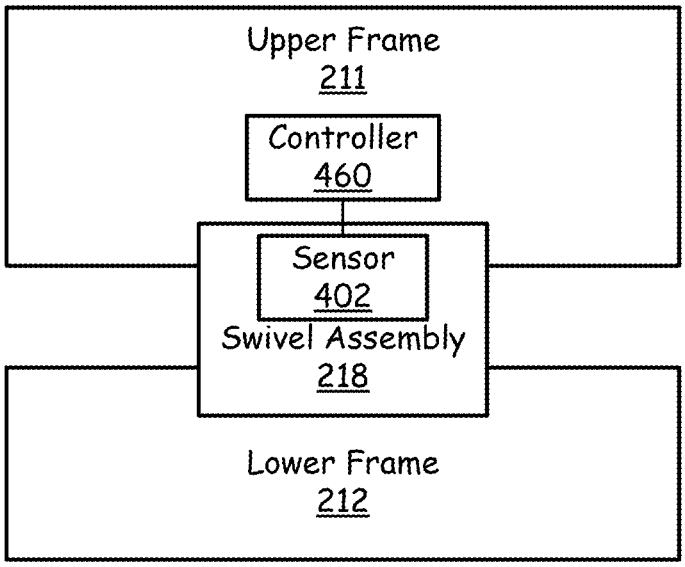
FIG. 5 is a block diagram illustrating the swivel assembly of FIG. 4 and illustrating a slew position sensor of the swivel assembly.
Figure 6:
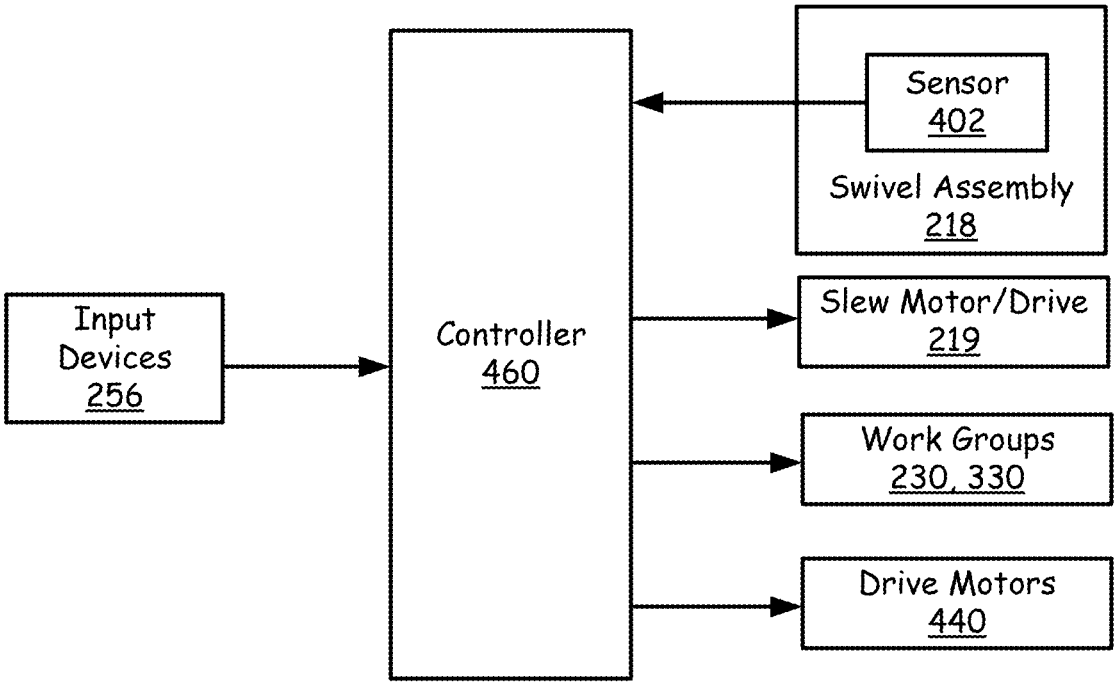
FIG. 6 is a block diagram illustrating a control system including the slew position sensor illustrated in FIG. 5.

Referring now to FIG. 5, shown in block diagram form is swivel assembly 218 which pivotally mounts upper frame portion or house 211 on lower frame portion or undercarriage 212. As shown in FIG. 5, control system 260 includes a control circuitry such as a controller 460, and the control circuitry is positioned in the upper frame portion 211 in exemplary embodiments. Controller 460 is configured to control excavator functions which utilize work groups such as the lift arm structures, the drive motors or other travel related components, the slew motor, etc. to perform work tasks. As illustrated in the block diagram of FIG. 6, controller 460 is configured to receive input signals from operator input devices 256. Controller is also configured to provide output signals to control the slew motor 219 and thereby the rotational position of the upper frame portion 211 relative to the lower frame portion 212, to control work group actuators such as the actuators of lift arm structures 230 and 330, and to control drive motors 440 of track assemblies 240A and 240B and thereby travel of the power machine.

In some embodiments, the control circuitry 460 can be configured to implement autonomous, automatic, or semi-automatic functions. To implement such functions, and more generally to operate excavator 200, it is beneficial to have an accurate indication of the rotational position of the upper frame portion 211 relative to the lower frame portion 212. To provide this "slew position" determination, disclosed embodiments of the swivel assembly 218 include a slew position sensor 402 which senses a slew position of the upper frame portion relative to the lower frame portion and provides a sensor output for use by controller 460. The controller 460 can then control the slew motor, the work group actuators, and the drive motors as a function of both of the user input signals from input devices 256 and the slew position sensor output.

In some exemplary embodiments described in further detail below with reference to FIGS. 7-9, slew position sensor 402 is mounted below a top of a swivel barrel of the swivel assembly. In some more particular embodiments, slew position sensor 402 is mounted proximate or below a bottom of a swivel spool or a swivel barrel of the swivel assembly. Having the sensor 402 and sensed element relatively close to each other without the need for a long intermediate component that is susceptible to thermal effects provides significantly more accurate slew position sensing over a desired range of operating temperatures. In some embodiments, slew position sensor 402 is mounted to the bottom of the swivel spool such that the sensing component of the sensor rotates with the upper frame portion 211. Such placement of the sensor 402 eliminates any need for a long element connecting through the swivel. Other components which work in conjunction with the slew position sensor 402, such as a magnet in some exemplary embodiments, can then be mounted to the swivel barrel of the swivel assembly such that these other components are stationary with respect to the lower frame portion. Having the sensor 402 mounted to the swivel spool such that it moves with the upper frame structure provides benefits in that any wires, cords o512*r* other electrical connections which connect the sensor 402 to control circuitry 460 also rotate with the upper frame portion and sensor, and therefore do not twist or wrap as the upper frame portion rotates relative to the lower frame portion. However, sensor 402 need not be mounted to the bottom of the swivel spool in all embodiments. For example, in some embodiments slew position sensor 402 includes wireless transmission capability such that the sensor can transmit the sensor output directly to controller or control circuitry 460. In such embodiments, slew position sensor 402 could be mounted to the swivel barrel instead of the swivel spool since wrapping of wires between the sensor and the control circuitry is not an issue. In embodiments in which the slew position sensor 402 is mounted to the swivel barrel, the corresponding magnet or other sensed feature would be mounted to the bottom of the swivel spool. In other embodiments described further below with reference to FIGS. 10-14, the sensor can be positioned external to the swivel assembly, for example concentrically around or offset from a swivel spool.

Figure 7:
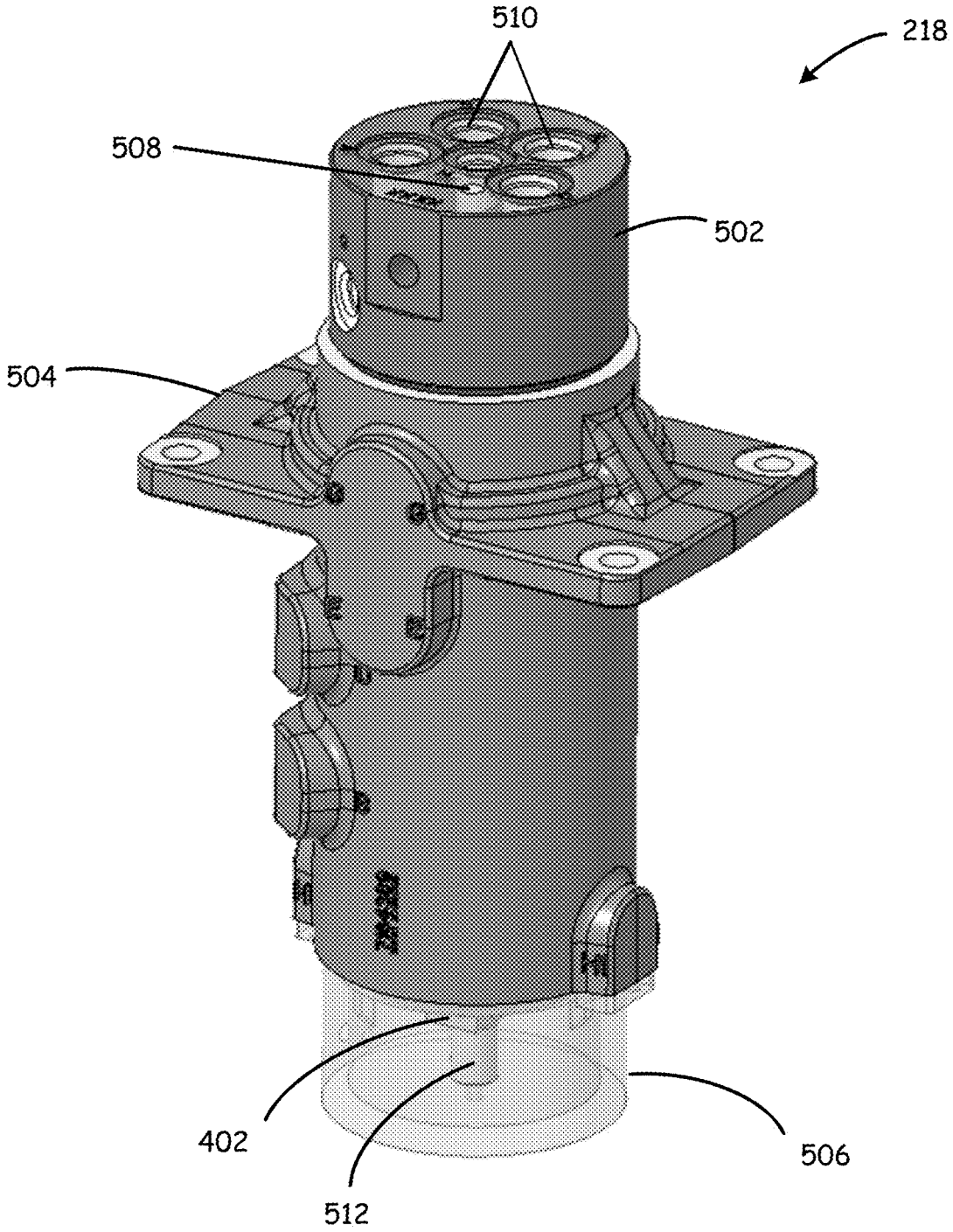
FIG. 7 is a perspective view of an exemplary embodiment of the swivel assembly shown in FIG. 5.

FIG. 7 is a perspective view of swivel assembly 218 in accordance with an exemplary embodiment. Swivel assembly includes a swivel spool 502 and a swivel barrel 504. Swivel barrel 504 is configured to be attached or mounted to lower frame portion or undercarriage 212, while swivel spool 502 is configured to be attached or mounted to the upper frame portion or house 211. Swivel spool 502 also includes a portion (not shown in FIG. 7) which extends through swivel barrel 504. As discussed further with reference to FIGS. 8-9, a sensor 402 is positioned beneath a bottom of the swivel spool, and in some embodiments is coupled or mounted to the bottom of the swivel spool 502 and/or beneath the bottom of the barrel (as shown in FIG. 7). A sensor wire bore 508 extends though the swivel spool 502 to allow one or more sensor wires 514 (represented in FIG. 9) to be routed through the bore to connect the sensor 402 to the control system (e.g., controller 460 or related circuitry) positioned in the upper frame portion 211. In embodiments in which power machine 200 includes a hydraulic system, swivel spool 502 will also typically include additional bores 510, which are often capped at the bottom of the spool, for hydraulic fluid connection between the upper and lower frame portions. The ability to have the sensor and sensed feature be aligned with the swivel axis, while also allowing the sensor wire bore to be offset from the swivel axis of the swivel spool provides significant advantages in design of the hydraulic port locations on the top of the swivel spool. Occupying the center of the top of the swivel spool with sensor related components can make hydraulic port location selection difficult given limited space, particularly on smaller swivel assemblies.

In some exemplary embodiments, sensor 402 is secured to a bottom surface of the swivel spool 502 at a position which is on the swivel axis 214. In other embodiments, sensor 402 can be positioned offset from the swivel axis. A cap 506, included in some embodiments, is attached or coupled to a bottom of swivel barrel 504. With cap 506 attached to barrel 504, the cap remains stationary relative to the lower frame portion 212 and provides a mount for a feature or component 512 which can be sensed by sensor 402 to aid in determining a rotational position of the upper frame portion 211 relative to the lower frame portion 212. In an exemplary embodiment, sensed component 512 is a magnet which is centered on the sensor 402 in an x-y plane (orthogonal to swivel axis 214). While in exemplary embodiments the magnet or other sensed component is centered on the sensor 402 on swivel axis 214, in some other embodiments for example using other sensor technologies, the sensed component can be offset from the swivel axis.

As discussed, in an exemplary embodiment, the sensed component 512 is a magnet. Sensor 402 can be a Hall-effect sensor configured to transduce magnetic fields from the magnet 512 into electrical signals indicative of the rotational position of the swivel spool relative to the swivel barrel, and thereby the rotational position of the upper frame portion or house 211 relative to the lower frame portion or undercarriage 212. In other embodiments, sensor 402 can be a Hall-effect sensor, and sensed component 512 can be a gear or gear set including ferromagnetic material. Further, while in some embodiments sensor 402 is a Hall-effect sensor, in other embodiments sensor 402 is of a type using a different technology. For example, in some embodiments, sensor 402 can be an optical sensor, and sensed feature or component 512 can be a code wheel or other mechanism or pattern which can be detected. Still other types of sensors and sensed components can be used in other embodiments.

Regardless of the particular sensor technology employed, in exemplary embodiments the sensed feature or component 512 is positioned below the top of the swivel barrel 504. In some embodiments, the sensed feature or component 512 is also below the bottom of the swivel spool 502 or below the bottom of the swivel barrel, and can be attached or coupled to the swivel barrel or lower frame portion. However, this need not be the case in all embodiments. In some such embodiments with the sensed feature or component below the bottom of the swivel spool or below the bottom of the barrel, the sensor 402 is attached or coupled to the swivel spool and rotates with the upper frame portion. In other embodiments, the sensor 402 can be proximate the bottom of the swivel spool or swivel barrel, but not positioned completely below the swivel spool or barrel. For example, in some embodiments, the sensor 402 is slightly inset relative to the bottom of the swivel spool in a recess 530 (shown in FIG. 9) within the swivel spool. This prevents any wire or wires coupled between the sensor 402 and the control system located on the upper frame structure from wrapping or being damaged as the upper frame portion 211 rotates relative to the lower frame portion 212. As noted, if sensor 402 is configured to wirelessly communicate with the control circuitry, the sensor 402 and sensed feature or component 512 can instead be coupled to the other of the swivel barrel and the swivel spool.

Figure 8:
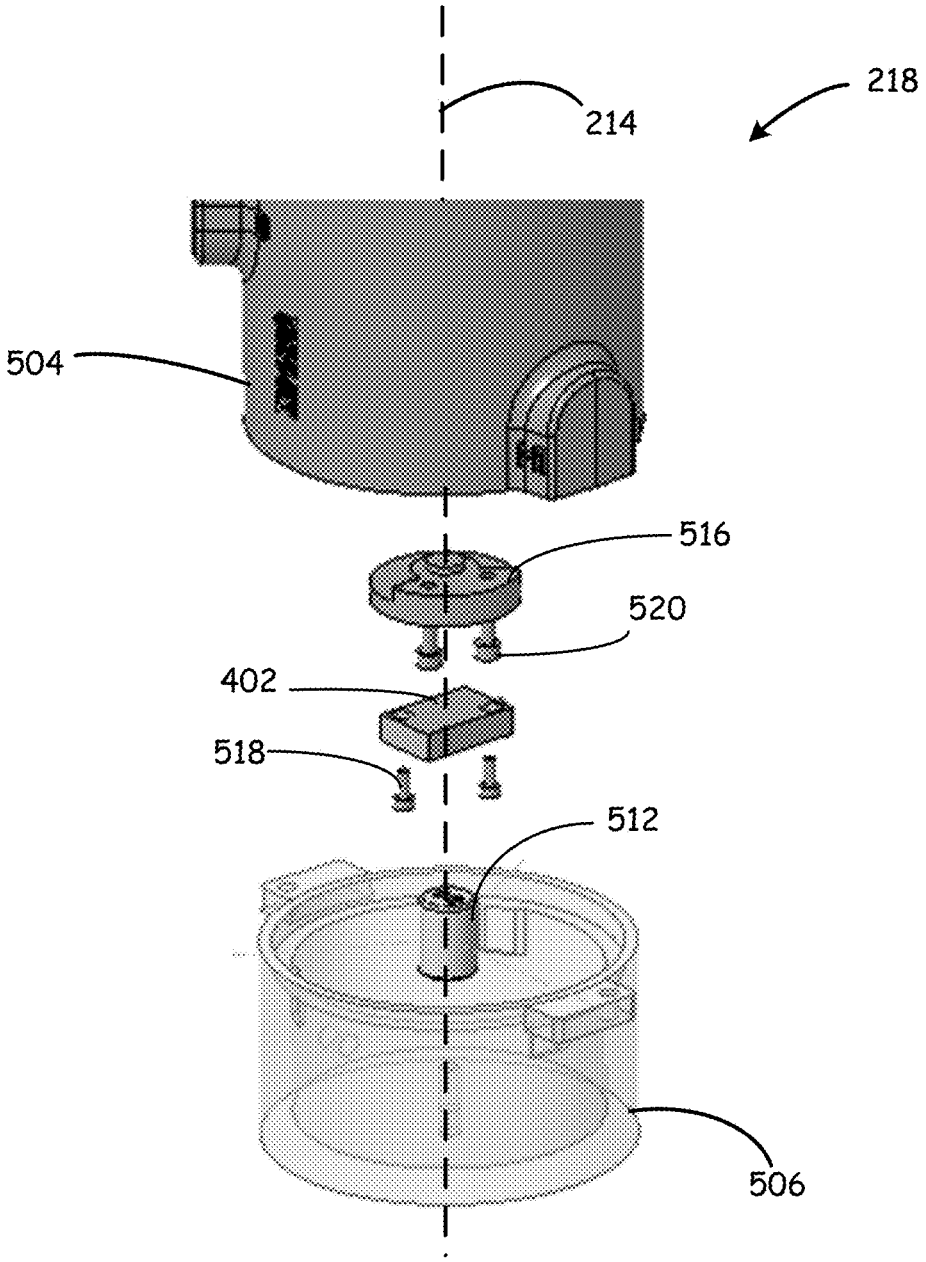
FIGS. 8-9 are perspective views illustrating sensor components of the swivel assembly shown in FIG. 7.
Figure 9:
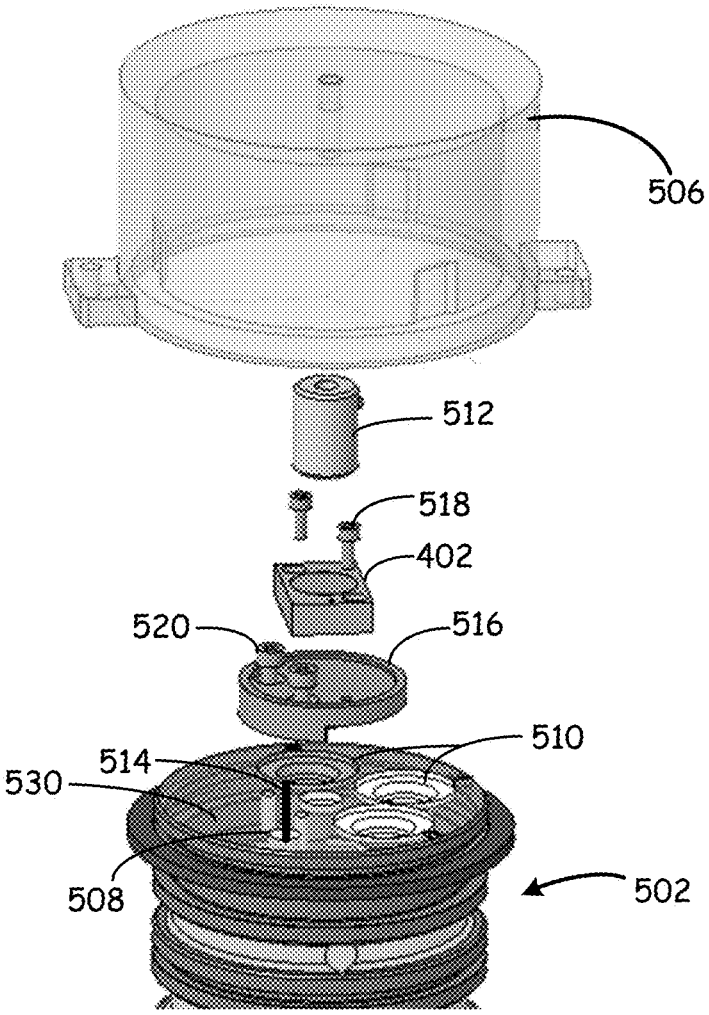

Referring now more specifically to FIGS. 8-9, shown are partially exploded views of a portion of swivel assembly 218 illustrating sensor and sensed component mounting features in accordance with an example embodiment. FIG. 8 illustrates portions of swivel assembly 218 from a top side perspective view to show swivel barrel 504, cap 506 and other components. FIG. 9 illustrates portions of swivel assembly 218 from a bottom side perspective view to show swivel spool 502, cap 506 and other components. Portions of swivel barrel 504 are removed from FIG. 9 to better illustrate swivel spool 502. As shown in FIGS. 8-9, swivel sensor 402 is mounted to a sensor adapter 516 by fasteners 518 or other fastening mechanisms or techniques. Sensor adapter 516 is mounted to a bottom of swivel spool 502 using piloting fasteners 520 or other fastening mechanisms or techniques, thereby mounting sensor 402 to the swivel spool 502. Sensed feature or component 512, a magnet in exemplary embodiments, is mounted to cap 506 such that when the cap is secured to the bottom of swivel barrel 504 the sensed component is positioned near sensor 402 in the vertical direction (i.e., the direction of swivel axis 214). Again, in some embodiments both of sensor 402 and sensed component 512 are aligned on the swivel axis 214, though that need not be the case in all embodiments.

The above-described example embodiments reduce sensor measurement errors caused by thermal effects over a thermal range, providing a significantly more accurate slew position measurement. This is accomplished in part by positioning the slew position sensor and sensed feature or component beneath the bottom of the swivel spool, particularly with each of the sensor and the sensed feature or component mounted coupled to different ones of the swivel spool and the swivel barrel. In wired sensor embodiments, the sensor is mounted to the bottom of the swivel spool such that the connecting wire routed through the swivel spool does not wrap or twist and the upper frame portion rotates relative to the lower frame portion. This design also allows the sensor wire bore through the swivel spool to be offset from the center or axis of the spool, providing flexibility in swivel assembly design with respect to placement of hydraulic ports in the swivel spool. These and other benefits of the disclosed embodiments of FIGS. 7-9 are understood by those of skill in the art.

Figure 10:
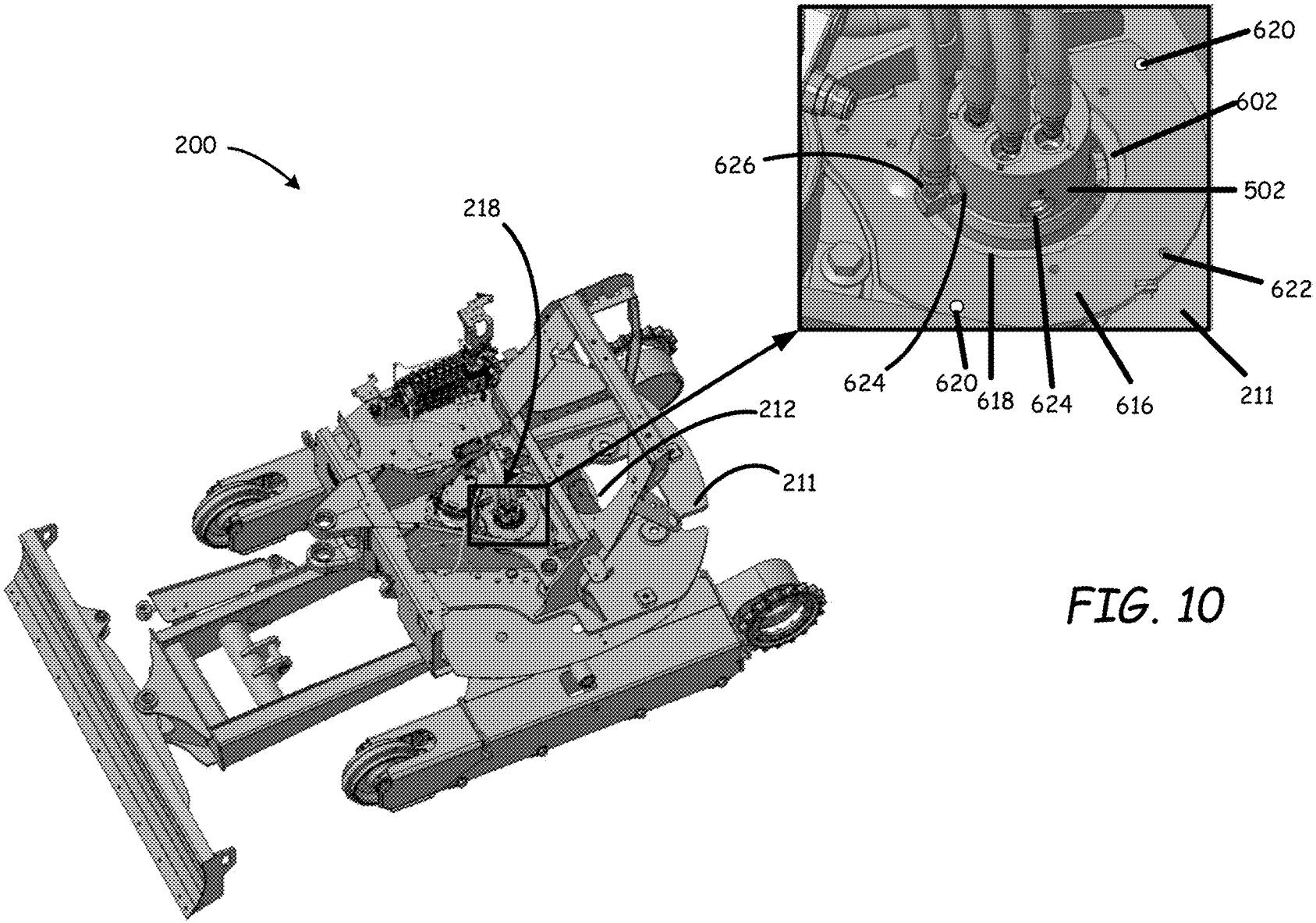
FIGS. 10-11 are perspective views of portions of a power machine illustrating a second slew position sensor embodiment.
Figure 11:
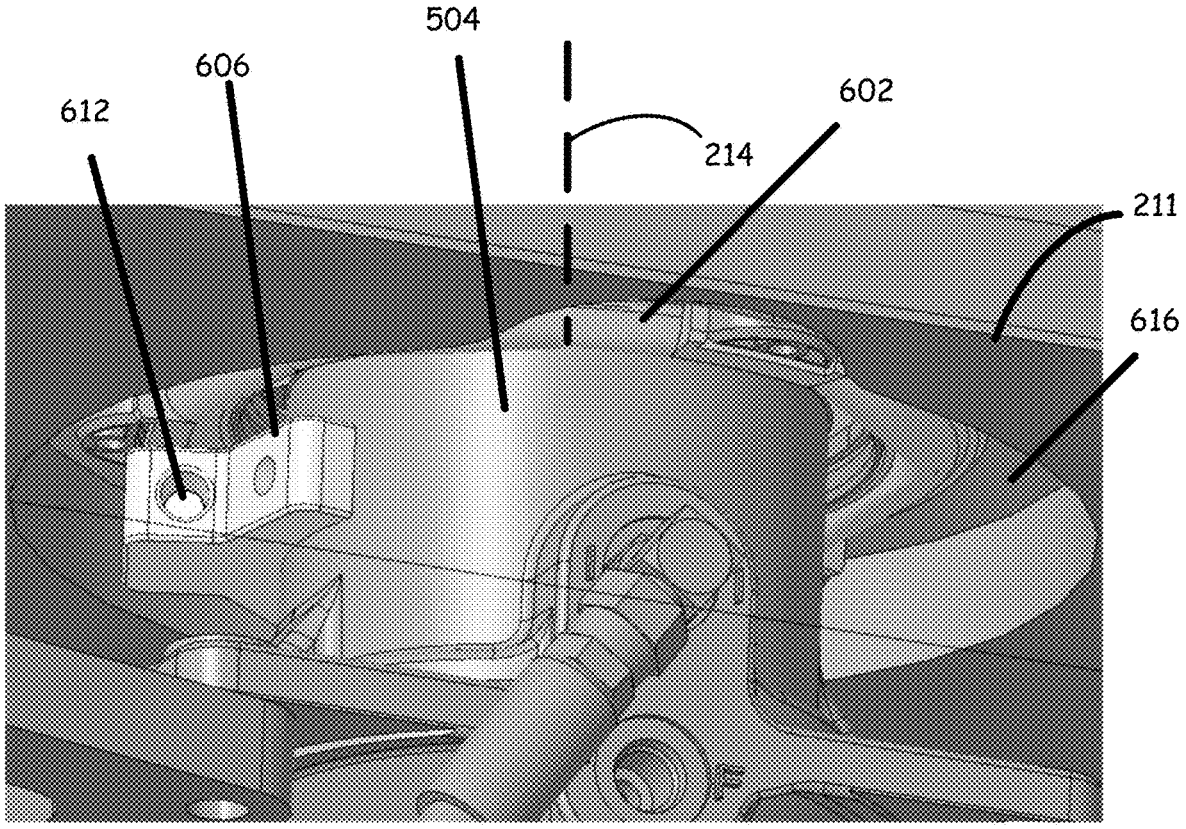
Figure 12:
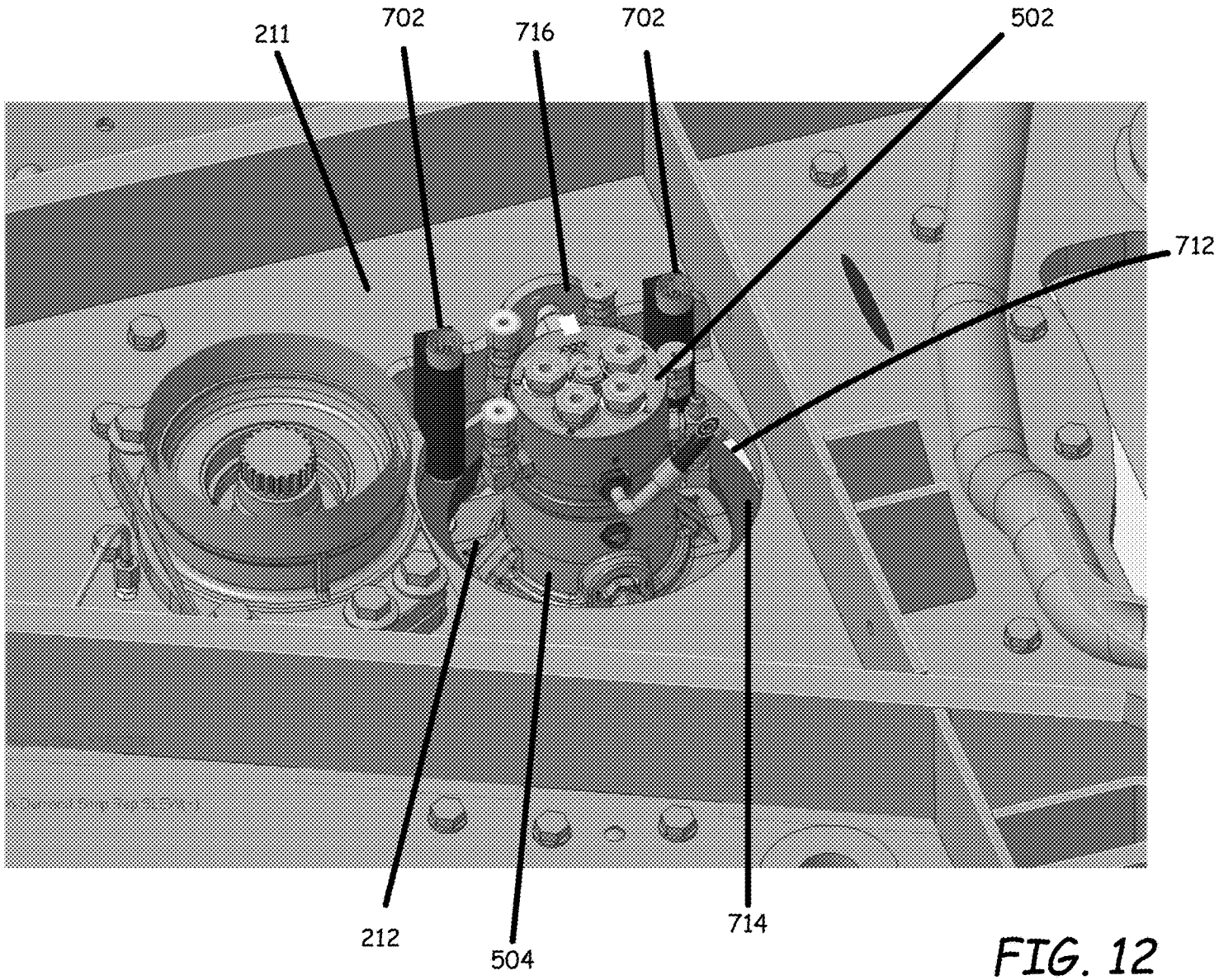
FIGS. 12-14 are perspective views of portions of a power machine illustrating a third slew position sensor embodiment.
Figure 13:
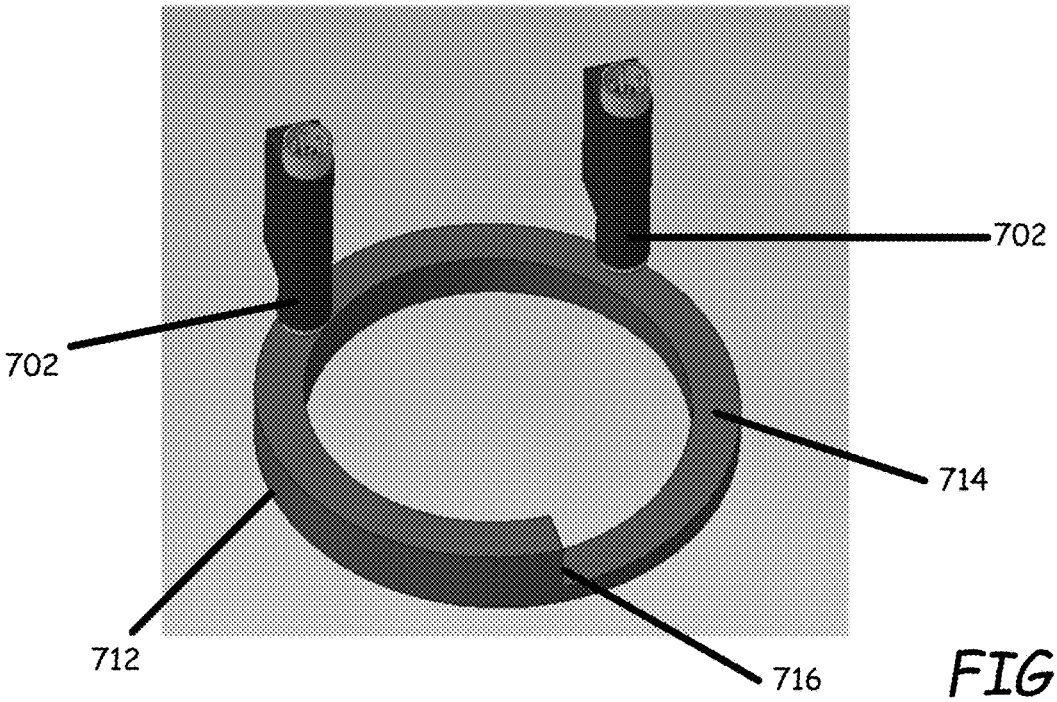
Figure 14:
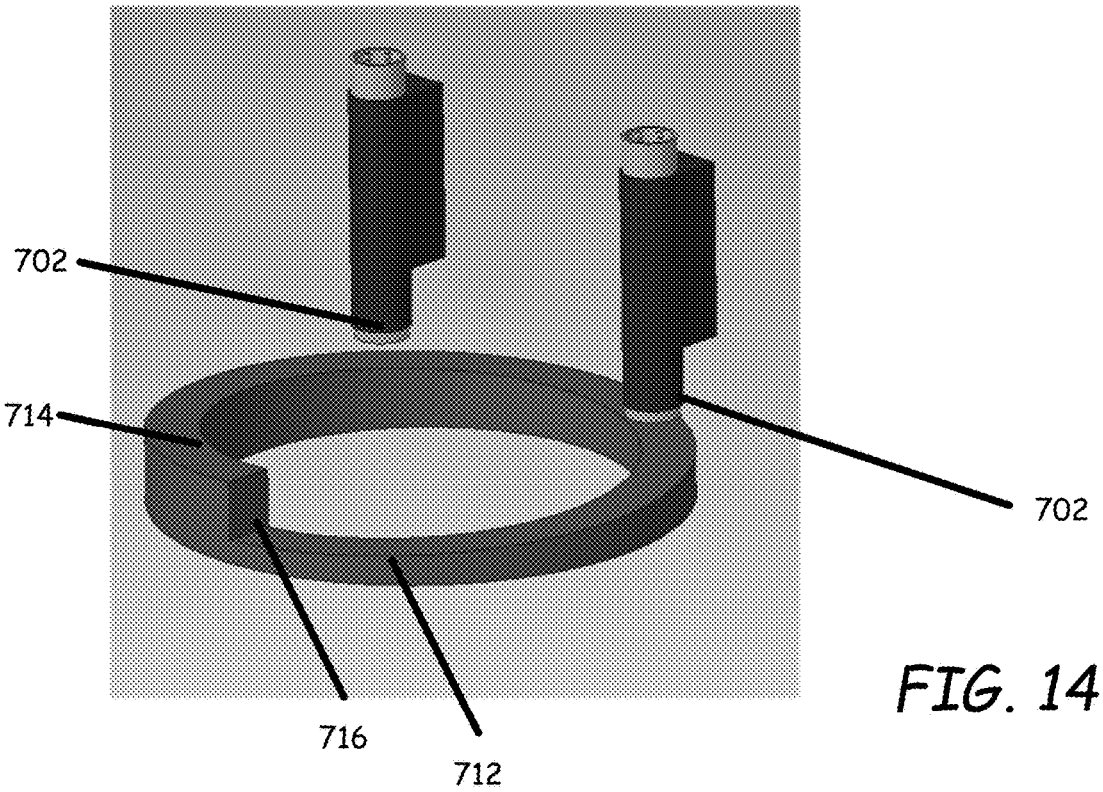

While in some embodiments the sensor and target or sensed component are positioned on the swivel axis 214 as discussed above, in other embodiments this need not be the case. For example, FIGS. 10-11 illustrate an embodiment with a sensor positioned concentrically around the outer diameter of the swivel spool and the axis of rotation 214 of the house 211. FIGS. 12-14 illustrate another embodiment with the sensor positioned external to and offset from the swivel spool and configured to measure a distance to a helical shaped target mounted to the swivel barrel or undercarriage. Both of the embodiments illustrated in FIGS. 10-14 provide accurate measurement of the slew or rotational position of the house relative to the undercarriage, without physical contact between the house supported structures and the undercarriage supported structures to facilitate the measurement process.

Referring now to FIGS. 10-11, shown are portions of another embodiment of power machine 200 having a swivel assembly 218 with swivel barrel 504 attached or mounted to lower frame portion or undercarriage 212, and swivel spool 502 attached or mounted to the upper frame portion or house 211. As shown in FIGS. 10-11, a sensor 602 is mounted to the house at a position which is external to the swivel spool 502. The sensor 602 is a generally circularly shaped sensor which is mounted in a position encircling the swivel spool. The sensor 602 is centered around or concentric to the swivel axis 214. In some exemplary embodiments, the sensor 602 is a circular Hall-effect sensor configured to sense a rotational position of a magnet or sensed component 612 mounted on the swivel barrel 504 or undercarriage 212. A circular Hall-effect sensor is available, for example, from Rota Limited of Manchester, United Kingdom. With the sensor 602 positioned concentrically about the machine's center of rotation, the sensor and controller 460 determine the absolute relative rotational or slew position between the house and undercarriage.

To mount sensor 602 in a position which is concentric around the axis of rotation of swivel spool 502, the sensor is secured to the bottom of a mounting plate 616 using fasteners or other securing mechanisms. The mounting plate 616 has an aperture 618 which is larger than the outer diameter of the swivel spool 502. With the sensor mounted to a bottom of the mounting plate 616, the mounting plate and sensor 602 are placed over the swivel spool such that the swivel spool 502 extends upward through the aperture 618. The mounting plate 616 is secured to a surface of the house 211, for example using bolts or other fasteners 620 extending through fastener apertures 622 in the mounting plate and in the surface of the house. This coupling technique secures the sensor to the house such that it rotates with the swivel spool 502 and the remainder of the house relative to the swivel barrel 504 and the remainder of the undercarriage. Positioning of sensor 602 such that it rotates with the house 211 is also beneficial for routing of any wiring between the sensor and the controller or control system 460 which is also typically positioned on the house. This coupling technique also advantageously positions the mounting plate and sensor 602 below hydraulic ports 624 positioned on the side of the spool. For this reason, the mounting plate 616 and sensor 602 are secured in position prior to attachment of hydraulic hoses 626 to hydraulic ports 624.

As shown in FIG. 11, a mount or target housing 606 for a target feature or component 612 is secured to swivel barrel 504 or to a portion of the undercarriage 212 which is stationary relative to the barrel. The target housing 606 can be a 3-D printed element or structure, or it can be formed using other methods. Target housing 606 that secures the target feature, which is a magnet, in position relative to the sensor 602. In some embodiments, the target housing is a non-ferrous metal, a plastic or other material which will not be magnetized or interfere with operation of the sensor 602. With the sensor 602 in a fixed position relative to the swivel spool and the house, and the target component 612 in a fixed position relative to the swivel barrel and undercarriage, the sensor senses the relative motion between the house and undercarriage, and outputs a signal directly indicative of the angular position of the house with respect to the undercarriage. The controller or control system uses the signal from sensor 602 to determine the slew position of the house.

Referring now to FIG. 12, shown are portions of another embodiment of power machine 200 having a swivel assembly 218 with a swivel barrel 504 attached or mounted to the undercarriage 212, and a swivel spool 502 attached or mounted to the house 211. As shown in FIG. 12, at least one sensor 702 is mounted to house 211 external to, and offset from, the swivel spool. In exemplary embodiments, two sensors 702 are included to improve accuracy, but a single sensor can be used in some embodiments. Further, three or more sensors can be included in some embodiments. In an exemplary embodiment, the one or more sensors 702 are mounted to a structure of the house by a mounting bracket 716. Other mounting configurations can also be employed.

Each sensor 702 is a proximity sensor which provides an output signal indicative of a distance between the sensor 702 and a surface 714 of a target or component 712 mounted to the swivel barrel 504 or a portion of the undercarriage 212. Target 712 is a helical ring oriented generally concentrically about the axis of rotation of the swivel assembly. The helical ring target 712 can be mounted to the swivel barrel 504 using fasteners and threaded apertures formed in the barrel, or by using other mounting techniques and mechanisms.

FIGS. 13-14 illustrate the helical ring target 712. As can be seen, a top surface 714 of the helical ring varies in vertical distance (i.e., distance in a direction parallel to the axis of rotation 214) from the proximity sensors 702, with each position of the top surface being a different distance from a particular proximity sensor. The output of the proximity sensor is correlated to a particular slew position or rotational position of the house relative to the undercarriage. The control system 460 is configured to use the output of the proximity sensor to identify that rotational position. Using two proximity sensors 702 provides redundancy and allows for processing of any sensor output voltage drop at the helix step 716. However, in some embodiments a single sensor is used.

In some embodiments, each sensor 702 is an inductive proximity sensor, and surface 714 of the helical ring target 712 is made from a metallic material such as sheet metal. However, in other embodiments, each sensor 702 is a Hall-effect sensor and the surface 714 includes a magnetic surface material. In still other embodiments, each sensor 702 is a time-of-flight laser distance sensor. In such embodiments, the surface 714 of the helical ring target can be formed using other material, such as a plastic material. All of these embodiments are contactless and avoid the addition of extra rotating parts, the meshing of parts, and other configurations that can fail due to wear, debris, etc.

As discussed above, for example with reference to FIGS. 10-14, a swivel assembly for a power machine is provided in some exemplary embodiments. The swivel assembly comprising a swivel barrel configured to be attached to a lower frame portion of the power machine, and a swivel spool configured to be attached to an upper frame portion of the power machine and to rotate relative to the swivel barrel about a swivel axis as the upper frame portion rotates relative to the lower frame portion. The swivel assembly further comprising a sensor target offset from the swivel axis and positioned external to the swivel barrel and the swivel spool, the sensor target configured to be coupled to the swivel barrel or lower frame portion of the power machine such that a sensor target position is fixed relative to the swivel barrel. The swivel assembly also comprising a swivel sensor offset from the swivel axis and positioned external to the swivel barrel and the swivel spool, the swivel sensor configured to be coupled to the swivel spool or upper frame portion of the power machine such that a swivel sensor position is fixed relative to the swivel spool, the swivel sensor configured to sense the sensor target to provide a sensor output indicative of a rotational position of the upper frame portion relative to the lower frame portion.

In some embodiments, the swivel sensor encircles the swivel spool, and can be positioned concentric to the swivel axis. In some embodiments, the swivel sensor is a circular Hall-effect sensor and the sensor target comprises a magnet.

In some embodiments, the swivel assembly further comprises a mounting plate configured to mount the swivel sensor to the upper frame portion of the power machine, the mounting plate having an aperture which is larger than an outer diameter of the swivel spool such that the swivel spool extends through the aperture when the swivel sensor is mounted to the upper frame portion by the mounting plate. In some embodiments, the swivel assembly further comprises a target housing which mounts the sensor target to the swivel barrel or lower frame portion of the power machine.

In some embodiments, the sensor target has a helical ring shape having a surface with varying distances from the swivel sensor, and the swivel sensor is a proximity sensor configured to provide the sensor output indicative of a distance between the swivel sensor and the surface of the sensor target. In some embodiments, the swivel sensor is an inductive proximity sensor, and the surface of the sensor target comprises a metallic material. In other embodiments, the swivel sensor is a Hall-effect sensor, and the surface of the sensor target comprises a magnetic material. In still other embodiments, the swivel sensor is a time-of-flight laser distance sensor. In these various embodiments, the swivel sensor can comprise first and second swivel sensors.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for description and should not be regarded as limiting. Words such as "including," "comprising," and "having" and variations thereof as used herein are meant to encompass the items listed thereafter, equivalents thereof, as well as additional items.

Although the present invention has been described with reference to preferred embodiments, workers skilled in the art will recognize that changes may be made in form and detail without departing from the scope of the discussion.

What is claimed is:

1. A swivel assembly for a power machine comprising:

a swivel barrel configured to be attached to a lower frame portion of the power machine;

a swivel spool configured to be attached to an upper frame portion of the power machine and to rotate relative to the swivel barrel about a swivel axis as the upper frame portion rotates relative to the lower frame portion, wherein a portion of the swivel spool extends through a portion of the swivel barrel; and a swivel sensor positioned below a top of the swivel barrel and configured to provide a sensor output indicative of a rotational position of the upper frame portion relative to the lower frame portion, wherein the swivel sensor is positioned in-line with the swivel axis.

2. The swivel assembly of claim 1, wherein the swivel sensor is coupled to the swivel spool proximate a bottom of the swivel spool and is further configured to rotate with the swivel spool and the upper frame structure.

3. The swivel assembly of claim 2, wherein the swivel sensor is coupled to the swivel spool at a position which is inset from the bottom of the swivel spool.

4. The swivel assembly of claim 1, and further comprising a sensed feature or component positioned proximate the swivel sensor below the top of the swivel barrel.

5. The swivel assembly of claim 4, wherein the sensed feature or component is coupled to the swivel barrel.

6. The swivel assembly of claim 4, wherein the swivel sensor is a Hall-effect sensor and the sensed feature or component is a magnet.

7. The swivel assembly of claim 4, and further comprising a sensed feature or component mount configured to be secured to a bottom of the swivel barrel.

8. The swivel assembly of claim 7, further including a cap that indirectly couples the sensed feature or component mount to the bottom of the swivel barrel, the cap configured with the bottom of the swivel barrel to enclose the bottom of the swivel spool.

9. The swivel assembly of claim 1, wherein the swivel spool further comprises a sensor wire bore offset laterally from the swivel axis and extending vertically through the swivel spool, and wherein the swivel sensor is configured to provide the sensor output over a sensor wire extendable through the sensor wire bore.

10. The swivel assembly of claim 1, wherein the swivel sensor is positioned proximate a bottom of the swivel spool or a bottom of the swivel barrel.

11. A power machine, comprising:

a frame including an upper frame portion and a lower frame portion;

control circuitry supported by the upper frame portion;

a plurality of tractive elements coupled to the lower frame portion;

a swivel assembly coupling the upper frame portion to the lower frame portion and configured to allow rotation of the upper frame portion relative to the lower frame portion, the swivel assembly comprising:

a swivel barrel attached to the lower frame portion of the power machine;

a swivel spool attached to the upper frame portion of the power machine and configured to rotate relative to the swivel barrel about a swivel axis as the upper frame portion rotates relative to the lower frame portion, wherein a portion of the swivel spool extends through a portion of the swivel barrel; and a swivel sensor positioned below a top of the swivel barrel and configured to provide a sensor output, indicative of a rotational position of the upper frame portion relative to the lower frame portion, to the control circuitry; and a slew motor configured to rotate the upper frame portion relative to the lower frame portion under the control of the control circuitry.

12. The power machine of claim 11, wherein the swivel sensor is positioned in-line with the swivel axis.

13. The power machine of claim 12, and further comprising a sensed feature or component positioned proximate the swivel sensor.

14. The power machine of claim 13, wherein the swivel sensor is positioned proximate a bottom of the swivel spool or a bottom of the swivel barrel.

15. The power machine of claim 14, wherein the swivel sensor is coupled to the swivel spool at a position which is inset from the bottom of the swivel spool.

16. The power machine of claim 14, wherein the swivel sensor is coupled to the bottom of the swivel spool.

17. The power machine of claim 14, wherein the swivel assembly further comprises a sensor adapter configured to couple the swivel sensor to the bottom of the swivel spool such that the swivel sensor rotates with the swivel spool and the upper frame structure, and wherein the sensed feature or component is coupled to the swivel barrel.

18. The power machine of claim 17, wherein the swivel sensor is a Hall-effect sensor and the sensed feature or component is a magnet.

19. The power machine of claim 12, wherein the swivel spool further comprises:

a sensor wire bore extending vertically through the swivel spool, and wherein the swivel sensor is configured to provide the sensor output over a sensor wire extendable through the sensor wire bore, the sensor wire bore being offset laterally from the swivel axis; and a plurality of hydraulic connection bores extending vertically from a top of the swivel spool to positions at least partially through the swivel spool.

* * * * *